United States Patent [19]

Tada et al.

[11] Patent Number: 4,786,886

[45] Date of Patent: Nov. 22, 1988

[54] FORCED-COOLED SUPERCONDUCTOR

[75] Inventors: Eisuke Tada; Hiroshi Tsuji; Takashi Kato; Tadao Hiyama; Susumu Shimamoto, all of Ibaraki, Japan

[73] Assignee: Japan Atomic Energy Research Institute, Tokyo, Japan

[21] Appl. No.: 23,106

[22] Filed: Mar. 6, 1987

[51] Int. Cl.[4] ..... H01F 7/22

[52] U.S. Cl. ..... 335/216; 335/300

[58] Field of Search ..... 335/216, 299, 300; 174/15 CA

[56] References Cited

U.S. PATENT DOCUMENTS

| | | | |
|---|---|---|---|
| 3,292,016 | 12/1966 | Kafka | 335/216 |
| 3,600,498 | 8/1971 | Aupoix | 335/216 |
| 4,568,900 | 2/1986 | Agatsuma et al. | 335/216 |
| 4,689,439 | 8/1987 | Sato | 335/216 X |

*Primary Examiner*—George Harris

*Attorney, Agent, or Firm*—Wenderoth, Lind & Ponack

[57] ABSTRACT

There is provided a forced-cooled superconductor including a conduit and a plurality of superconducting strands disposed within the conduit in spaced relationship. A coolant passes through the spaces between the strands for cooling the conduit and strands. The conduit and strands are further cooled by means of an additional separate cooling channel which cooperates with the coolant for cooling the conduit and strands.

5 Claims, 1 Drawing Sheet

FORCED-COOLED SUPERCONDUCTOR

BACKGROUND OF THE INVENTION

This invention relates to improvements in forced-cooled superconductor.

Of late, there is the tendency that superconducting coils operated at temperatures of liquid helium are increased in size and operated at large currents and thus the superconducting coils are required to have high mechanical strength and electric insulation capability. There are various cooling methods for the superconducting coils, that is, for example, the pool-cooling method in which the superconductor is cooled in a liquid helium bath and the forced-cooled method in which supercritical helium is supplied to and circulated through the cooling channel in a superconductor. Although the forced-cooled method is superior to the pool-cooling method with respect to mechanical strength and electric insulation capability, the former system has the drawback that the system gives lower stability margin of the coils.

FIG. 4 shows one example of the ordinary forced-cooled superconductors, which is composed of a conduit 1 formed of metal or plastic and twisted superconducting strands 2 disposed within the conduit 1 and a coolant 3 such as helium gas, for example, is passed through the spaces between the superconducting strands within the conduit. In order to increase the stability margin of the forced-cooled superconducting coils with the ordinary geometry shown in FIG. 4, the twisted-stranded cables are disposed within the conduit to thereby increase the cooling perimeter of the stranded cables with respect to the helium gas as the coolant. However, the ordinary superconductor has the disadvantage that since the many stranded cables are disposed within the conduit, high pressure drop of helium gas as a coolant through the conductor is substantial, resulting in temperature rise and in lower coolant speed whereby a thermal disturbance externally induced in an upstream zone of the flow passage causes a so-called transition normal state in the portion of the conductor disposed in a downstream zone in the flow passage.

SUMMARY OF THE INVENTION

The purpose of the present invention is to provide a forced-cooled superconductor which can effectively eliminate the disadvantage of the ordinary forced-cooled superconductor referred to hereinabove.

For attaining the object, according to the present invention, in addition to the cooling channel by a coolant passing through the spaces between the strands disposed within the conduit to cool the conduit and strands, an additional separate cooling channel is provided in the interior or on the exterior of the conduit to cool the conduit and strands.

The above and other objects and attendant advantages of the present invention will be more readily apparent to those skilled from a reading of the following description in conjunction with the accompanying drawings which show the ordinary and preferred embodiments of the present invention.

BRIEF DESCRIPTION OF THE DRAWINGS

FIG. is a sectional view of a first embodiment of the forced-cooled superconductor according to the present invention.

PREFERRED EMBODIMENT OF THE INVENTION

Figure 1:
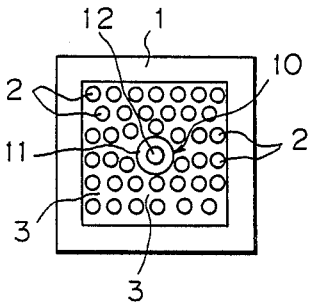

The present invention will be now described referring to the accompanying drawing.

Throughout various figures of the drawings, the same reference numerals denote the same or corresponding components.

Figure 2:
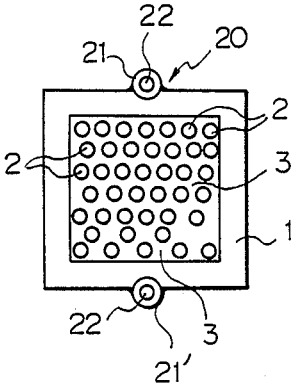
FIG. 2 is a sectional view of a second embodiment of the forced-cooled superconductor according to the present invention.
Figure 3:
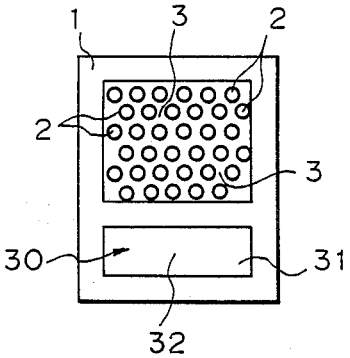
FIG. 3 is a sectional view of a third embodiment of the forced-cooled cooling type superconductor according to the present invention.
Figure 4:
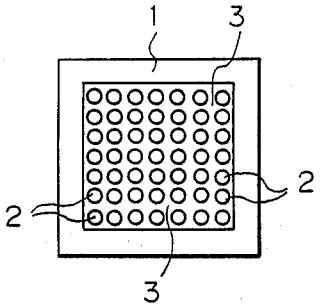
Fig. 4 PRIOR ART
FIG. 4 is a sectional view of the ordinary forced-cooled superconductor.

FIGS. 1 through 3 show the first to third embodiments of the forced-cooled superconductors according to the present invention and FIG. 4 shows the ordinary forced-cooled superconductor.

First, referring to FIG. 1 which shows the first embodiment of the forced-cooled superconductor of the invention in the embodiment, a cooling channel 10 is provided within a conduit 1 for cooling the conduit 1 and superconducting strands 2 in addition to the cooling channel of helium gas as the coolant referred to hereinabove. The cooling channel 10 comprises a cooling tube 11 disposed in the center of the pack of the superconducting strands 2 and a coolant 12 which passed through the cooling tube 11. The coolant 12 may be helium gas, for example.

Thus, the helium gas 12 passing through the cooling tube 11 cools the superconducting strands 2 in cooperation with the helium gas 3 which passes through the spaces between the superconducting strands 2.

The helium gas 12 passing through the cooling tube 11 and the helium gas 3 passing through the spaces between the superconducting strands 2 are preferably supplied from and circulated through a common supply-circulation system (not shown).

Referring to FIG. 2 in which the second embodiment of the forced-cooled superconductor of the present invention is shown. In the second embodiment, the cooling channel 10 in the first embodiment is replaced by cooling channel 20 provided on the exterior of the conduit 1. The cooling channel 20 comprises two cooling tubes 21 and 21' provided on the outer surfaces of two opposing side walls of the conduit 1 and a coolant 22 passing through the cooling tubes such as helium gas.

FIG. 3 shows the third embodiment of the forced-cooled superconductor according to the present invention. The third embodiment of the forced-cooled superconductor is provided with a cooling channel 30 different from the corresponding components in the previous embodiments. The cooling channel 30 comprises a coolant passage 31 formed in the conduit 1 itself and defined by one side wall and the two opposing side walls disposed at right angles to the one side wall and a coolant 32 passing through the passage 31 such as helium gas for example.

In the foregoing three embodiments of the forced-cooled superconductor according to the present invention when the coolant such as helium gas, for example, is passed through the spaces between the superconducting strands and the cooling tube (tubes) or the coolant passage, the conduit 1 and superconducting strands 2 are positively cooled to about −269° C.

As is clear from the foregoing description of the preferred embodiments of the present invention, according to the present invention, since the cooling channel can positively cool the conduit and superconducting strands, high stability margin of the conductor can be attained. In addition, the additional cooling channel gives lower pressure drop through the conductor, so that the initial cool-down from room temperature to −269° C. can be easily attained, and the temperature rise owing to the pressure drop can be sufficiently decreased. Furthermore, given that the coolant speed passing through the additional cooling tube or tubes in the cooling channel can be increased, any thermal disturbance externally induced in an upstream zone of the flow passage can be rapidly expelled by the additional cooling channel and thus, the portion of the conductor disposed in a downstream zone of the flow passage will not be adversely affected.

Although specific embodiments of the invention have been described and illustrated herein, any changes and modifications will of course suggest themselves to those skilled in the art. The embodiments have been selected for this disclosure for the purpose of illustration only. The present invention should therefore not to be limited to the embodiments so selected, the true scope of the invention being defined only in the appended claims.

What is claimed is:

1. A forced-cooled superconductor comprising:

a conduit;

a pack including a plurality of superconducting strands disposed in spaced relationship within said conduit, said superconducting strands defining spaces therebetween for passing coolant through the spaces for cooling said superconducting strands and said conduit; and an additional separate cooling channel in heat exchange relationship with at least one of said conduit and said pack of said plurality of superconducting strands for cooling said conduit and said pack of said plurality of superconducting strands in addition to the cooling spaces defined by said plurality of superconducting strands.

2. The forced-cooled superconductor as set forth in claim 1, wherein said plurality of superconducting strands and said additional separate cooling channel each has means for withstanding helium gas as a coolant.

3. The forced-cooled superconductor as set forth in claim 1, in which said additional separate cooling channel comprises a cooling tube disposed in the center of said pack of said plurality of strands.

4. The forced-cooled superconductor as set forth in claim 1, in which said additional cooling channel comprises two cooling tubes attached to the outer surfaces of opposing side walls of said conduit.

5. The forced-cooled superconductor as set forth in claim 1, in which said additional cooling channel comprises a coolant passage in said conduit, said coolant passage being defined by one side wall of said conduit, and extending substantially the entire width of said one side wall of said conduit for providing additional separate cooling for said plurality of superconducting strands.

* * * * *